United States Patent [19]

Valenti

[11] Patent Number: 5,065,186

[45] Date of Patent: Nov. 12, 1991

[54] MAGNETIC EMISSIONS REDUCTION APPARATUS AND METHOD

[75] Inventor: Anthony Valenti, Central Islip, N.Y.

[73] Assignee: NCR Corporation, Dayton, Ohio

[21] Appl. No.: 518,371

[22] Filed: May 3, 1990

[51] Int. Cl.[5] ..... H01H 1/00

[52] U.S. Cl. ..... 335/213; 335/211; 315/397; 315/371; 363/21

[58] Field of Search ..... 335/211, 212, 213, 214; 315/1, 371, 382.1, 397, 399, 408; 358/141, 142, 143; 360/33.1, 38.1; 363/21, 22, 23, 24, 25, 26

[56] References Cited

U.S. PATENT DOCUMENTS

| | | | |
|---|---|---|---|
| 4,074,210 | 2/1978 | Otake et al. | 333/29 |
| 4,095,206 | 6/1978 | Hishiki | 336/96 |
| 4,272,705 | 6/1981 | Beaumont | 315/399 |
| 4,496,882 | 1/1985 | Oliver | 315/371 |
| 4,527,229 | 7/1985 | Imamura et al. | 363/126 |
| 4,636,693 | 1/1987 | Saruta | 335/212 |
| 4,709,220 | 11/1987 | Sakane et al. | 335/214 |
| 4,725,936 | 2/1988 | Nakajima et al. | 363/21 |
| 4,806,894 | 2/1989 | Koto . | |
| 4,870,330 | 9/1989 | Van Tiel | 335/213 |
| 4,975,618 | 12/1990 | Koba et al. | 335/214 |

OTHER PUBLICATIONS

U.S. Patent application Ser. No. 084,949 filed Aug. 13, 1987, by Joseph F. Hevesi for "Magnetic Shunt for Deflection Yokes".

*Primary Examiner*—Leo P. Picard
*Assistant Examiner*—Trinidad Korka
*Attorney, Agent, or Firm*—Jack R. Penrod

[57] ABSTRACT

An special arrangement of the magnetic components of a horizontal sweep output circuit to reduce the net flux density and magnetic induction that are present at the exterior of a video display. The special arrangement meets the new, lower VLF electro-magnetic emission standards of some of the European countries, such as Sweden. The method used for obtaining this special arrangement of horizontal sweep output components is also disclosed.

6 Claims, 4 Drawing Sheets

MAGNETIC EMISSIONS REDUCTION APPARATUS AND METHOD

BACKGROUND OF THE INVENTION

The present invention relates to cathode ray tube (CRT) devices such as video display terminals or television sets, and more particularly to reducing electro-magnetic emissions from horizontal sweep output sections of such CRT devices.

Most CRTs utilize a rapidly varying magnetic field created by specially wound coils to sweep a ray of electrons from a heated cathode across a phosphor coated screen to form words and/or images. The coil that controls the horizontal motion of the cathode ray is called the horizontal deflection circuit, and it is driven by the horizontal sweep circuit. Although there are some variations in timing, the cathode ray typically sweeps horizontally across the screen in approximately 1/25,000 th of a second.

During each horizontal sweep, the horizontal sweep circuit drives the horizontal deflection coil with a ramp or sawtooth signal that controls the horizontal sweep of the cathode ray across the CRT screen. At the end of each horizontal sweep, an extremely rapid ramp signal causes the cathode ray to sweep back to the starting point to begin the next horizontal sweep. Because of the extremely rapid trip back to the starting point, the transformer that drives and controls the sweep and rapid return sweep is called a flyback transformer. Thus, the flyback transformer is driven by a ramp of current that is approximately 1/25,000 th of a second in duration, followed by an oppositely sloped current ramp that is extremely short in duration.

With a sweep cycle of 1/25,000 of a second, it is understandable that the flyback transformer operates at approximately 25,000 hz, and because the flyback transformer is driven by a ramp shaped current, it is understandable that the magnetic flux of the flyback transformer is rich in harmonics of 25,000 hz.

In order to control the width of the horizontal sweep across the screen, many video display terminals and/or television sets employ a variable coil that is in series with the primary winding of the flyback transformer, which is called the horizontal width coil. Those horizontal sweep circuits which have a horizontal width coil, usually have a non-adjustable horizontal linearity coil in series with the horizontal width coil. The horizontal linearity coil has a ferrite core which is magnetized such that its inductance is a function of both the level and the direction of the current passing through it. The horizontal linearity coil compensates for the fact that the path of the cathode ray as it sweeps across the screen has non-linearities. A non-linear sweep would mean that some characters or images would have undesirable uneven proportions from left to right on the screen. Thus, the output of the horizontal sweep circuit has a linearity coil, a width coil and a flyback transformer primary.

The horizontal width coil and the horizontal linearity coils are basically solenoids in shape. If these coils were not in the proximity of other conductive or permeable material, each would exhibit a toroidal magnetic flux field. Further, because the flyback transformer is a non-ideal inductive transformer, it has a leakage flux. Because of the horizontal sweep drive current flowing through these inductive components, their individual fluxes will have harmonics in the very low frequency (VLF) band of electro-magnetic emissions.

A problem with the above described horizontal sweep output circuit has arisen because of its level of electro-magnetic emissions. Many countries, especially European countries, have decided to control the amount of ambient electro-magnetic emissions in the workplace. To this end, these countries have specified a maximum level of VLF electro-magnetic emissions that are permitted in the near field proximity of a video display or similar device. Sweden, for example, specifies that video displays shall have magnetic emissions that have a magnetic induction that is less than 24 milli-Teslas per second and a magnetic flux density less than 50 nano-Teslas at a distance of 0.3 m. from the front surface of the display. Additionally, Sweden specifies that at 0.5 m. from any exterior surface that a video display shall have a magnetic induction of less than 24 milli-Teslas per second and a magnetic flux density of less than 50 nano-Teslas. Because of the level of net electro-magnetic emissions from the horizontal width coil, the horizontal linearity coil and the flyback transformer, some video displays are unable to meet the lower European specifications, such as Sweden's.

SUMMARY OF THE INVENTION

According to one aspect of the invention, the foregoing problem is solved by providing a horizontal sweep output circuit for a CRT, including: a flyback transformer having a leakage flux; and a horizontal width coil having a flux with a direction that is opposed to the leakage flux. The horizontal width coil is proximately located to the flyback transformer such that part of its flux cancels part of the leakage flux, such that the net flux that is located in the near proximity of the horizontal sweep output circuit is less than the leakage flux emitted by the flyback transformer alone.

In accordance with another aspect of the invention, the aforementioned problem is solved by providing a method for reducing a net flux located in a near proximity of a display device having a flyback transformer that has a leakage flux, a horizontal width coil that has a first flux, and a horizontal linearity coil that has a second flux. This method includes the step of arranging the flyback transformer, the horizontal width coil and the horizontal linearity coil such that a portion of the first flux, a portion of the second flux and a portion of the leakage flux nullify each other.

It is an object of the present invention to provide a horizontal sweep output circuit that has a reduced magnetic flux located in its near proximity.

It is another object of the present invention to provide a method for reducing the amount of magnetic flux located in the near proximity of a video display because of a leakage flux from its flyback transformer.

BRIEF DESCRIPTION OF THE DRAWINGS

While the specification concludes with the appended claims particularly pointing out and distinctly claiming the subject matter which is regarded as the invention, it is believed that the invention will be better understood from the following detailed description of the illustrative embodiment taken in conjunction with the accompanying drawings in which:

DETAILED DESCRIPTION OF A PREFERRED EMBODIMENT

Figure 1:
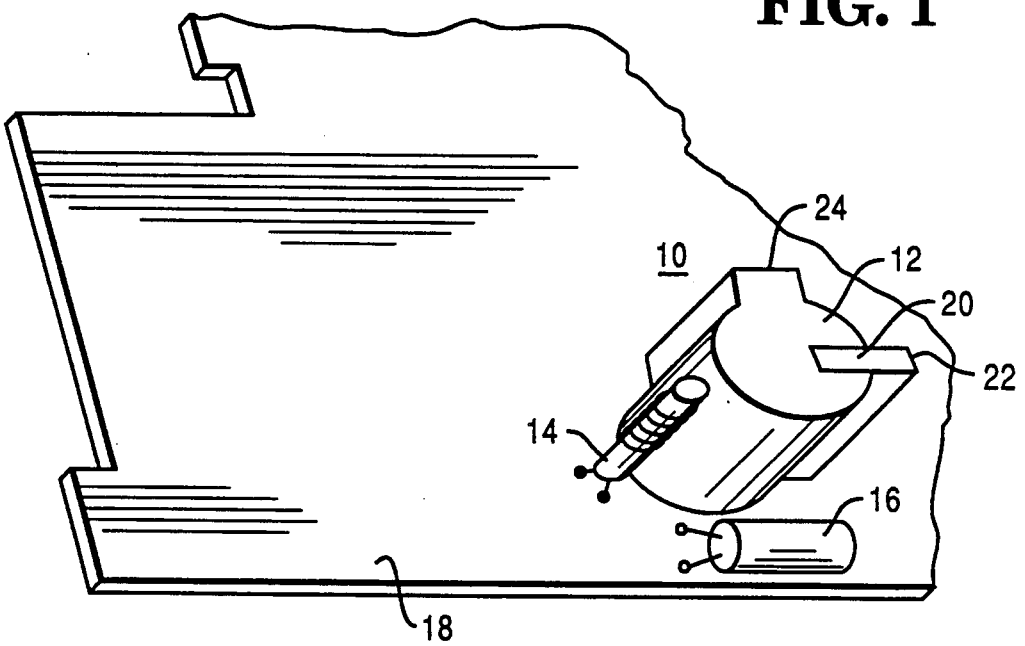
PRIOR ART FIG. 1
FIG. 1 is a simplified perspective view of a horizontal sweep output circuit of an existing video display.

Referring to FIG. 1, there is shown a perspective view of a horizontal sweep output circuit 10 of a known video display. The horizontal sweep output circuit 10 includes a flyback transformer 12, a horizontal width coil 14, and a horizontal linearity coil 16 mounted on a printed circuit board 18. The horizontal sweep output circuit 10 is driven by a horizontal sweep oscillator (not shown in FIG. 1) in a manner known in the art. Further, the horizontal sweep output circuit 10 is connected to video circuits that control the horizontal sweeping of cathode ray electrons across a CRT screen (not shown) in a manner that is known in the art.

The flyback transformer 12 is primarily cylindrical in shape, and it is mounted with its axis substantially perpendicular to the printed circuit board 18. This known flyback transformer 12 has core 20. A portion of the core 20 is visible as a rectangular protrusion 22 from the primary cylindrical flyback transformer 12. A second rectangular protrusion 24 provides a housing for high voltage rectifiers, the use of which is well known in the art.

The width coil 14 is also substantially cylindrical in shape. It is mounted with its axis substantially perpendicular to the printed circuit board 18 and substantially parallel to the axis of the flyback transformer 12. The inductance of the width coil is adjustable, in a well known manner, by changing the position of a high permeability slug (not shown) with respect to the coil windings and thereby changing the overall reluctance of its flux path. Decreasing the reluctance, increases the inductance of the width coil 14.

The linearity coil 16 is not manually adjustable; however, it has a ferrite core whose reluctance varies with the level and the direction of the current flowing through it. The linearity coil is connected in series with the width coil 14, as shown in FIG. 2B and its varying inductance is used to compensate for differences in the path of the cathode ray of electrons as they are swept across the display screen (not shown) during each horizontal sweep.

Figure 2A:
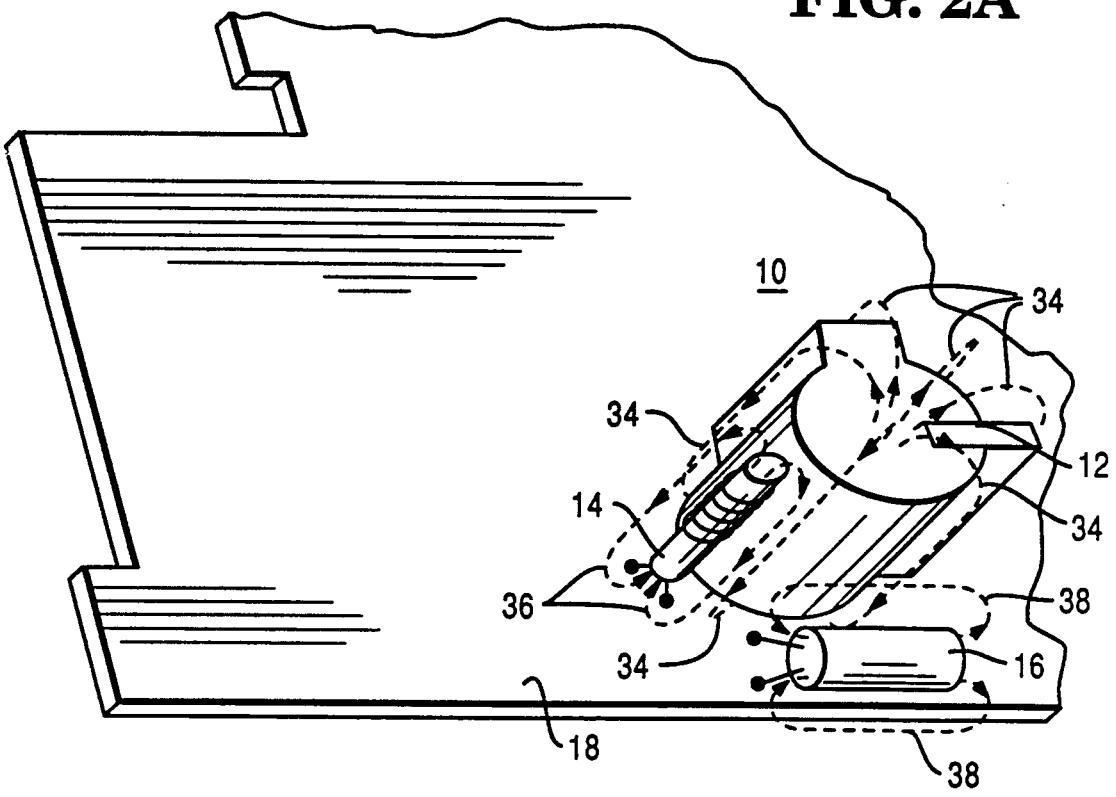
PRIOR ART FIG. 2A
FIG. 2A is a pictorial representation of the magnetic flux of the horizontal sweep output circuit shown in FIG. 1.
Figure 2B:
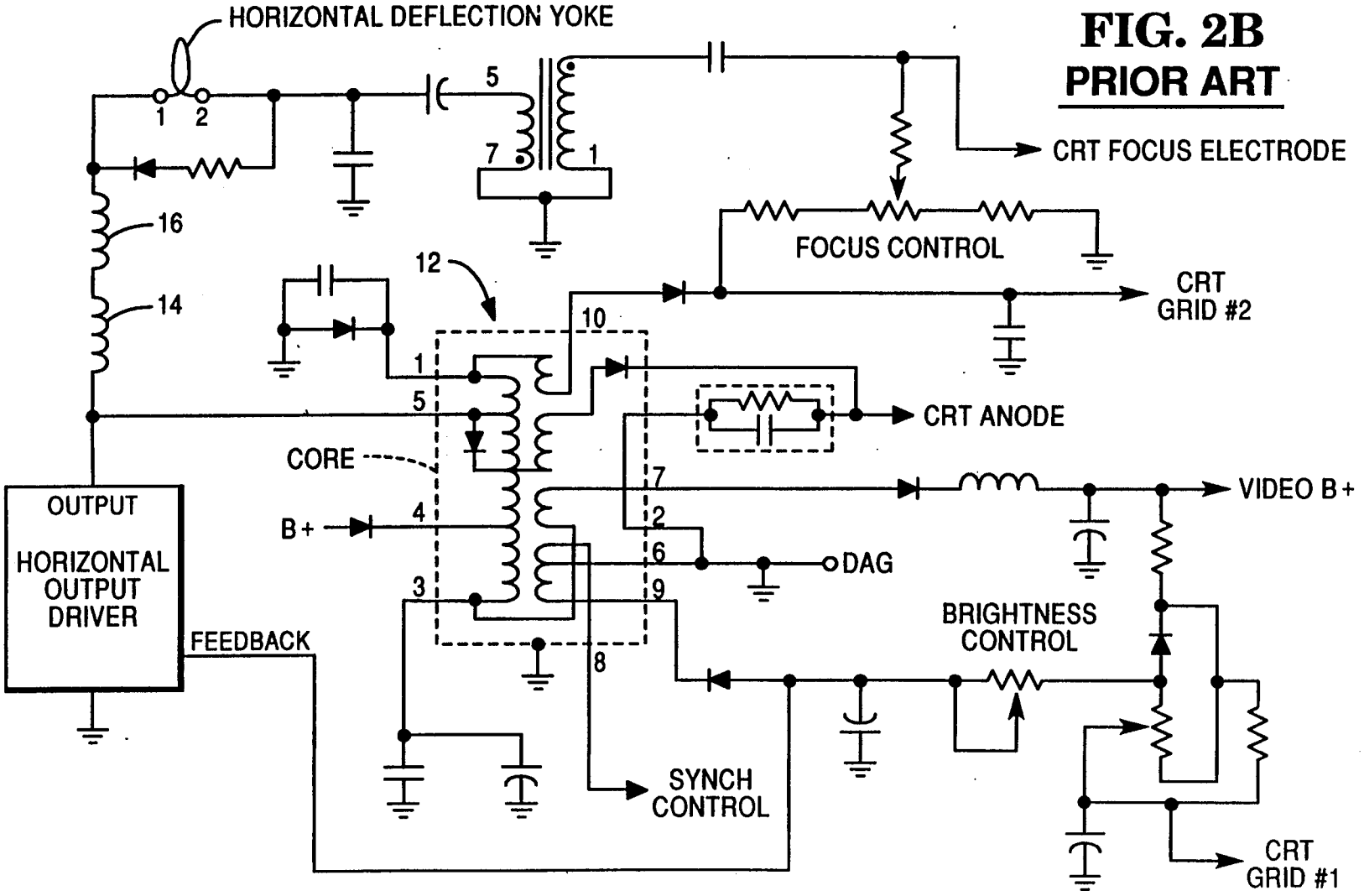
FIG. 2B PRIOR ART
FIG. 2B is a simplified electronic circuit diagram of a horizontal sweep circuit of a cathode ray tube.

Referring now to FIG. 2A, the inductive consequences of this known design are described. Flyback transformer 12, as all transformers, has an inherent leakage inductance. A leakage inductance is caused by the fact that some of the flux induced by the current flowing in its primary winding (not shown) is not linked to any secondary winding (not shown). This flux is called a leakage flux 34 because it leaks out from the primary winding without being mutually linked to the secondary windings. Because the energy stored in the leakage flux 34 to cannot be transduced to the secondary windings by mutual flux linkages, the leakage flux has the appearance of an inductance which is in series with the primary winding of the flyback transformer 12. Those skilled in the art will appreciate that there is an additional leakage flux component present which is caused by the imperfections of the secondary windings. For the purposes of this discussion, the secondary leakage flux is considered to as if it were reflected as an equivalent amount of additional primary leakage flux 34. Thus, the leakage flux 34, shown in FIG. 2A, represents the fluxes from all of the leakage inductances of the flyback transformer 12.

The width coil 14 and the linearity coil 16, do not have leakage fluxes as that term is used with regard to transformers; however, since these coils 14 and 16 are substantially solenoids, their fluxes 36, 38 are substantially toroidal as shown in FIG. 2A. Because of the placement and orientation of coils 14 and 16 with respect to each other and with respect to the flyback transformer 12, their fluxes do not interact much.

Figure 3:
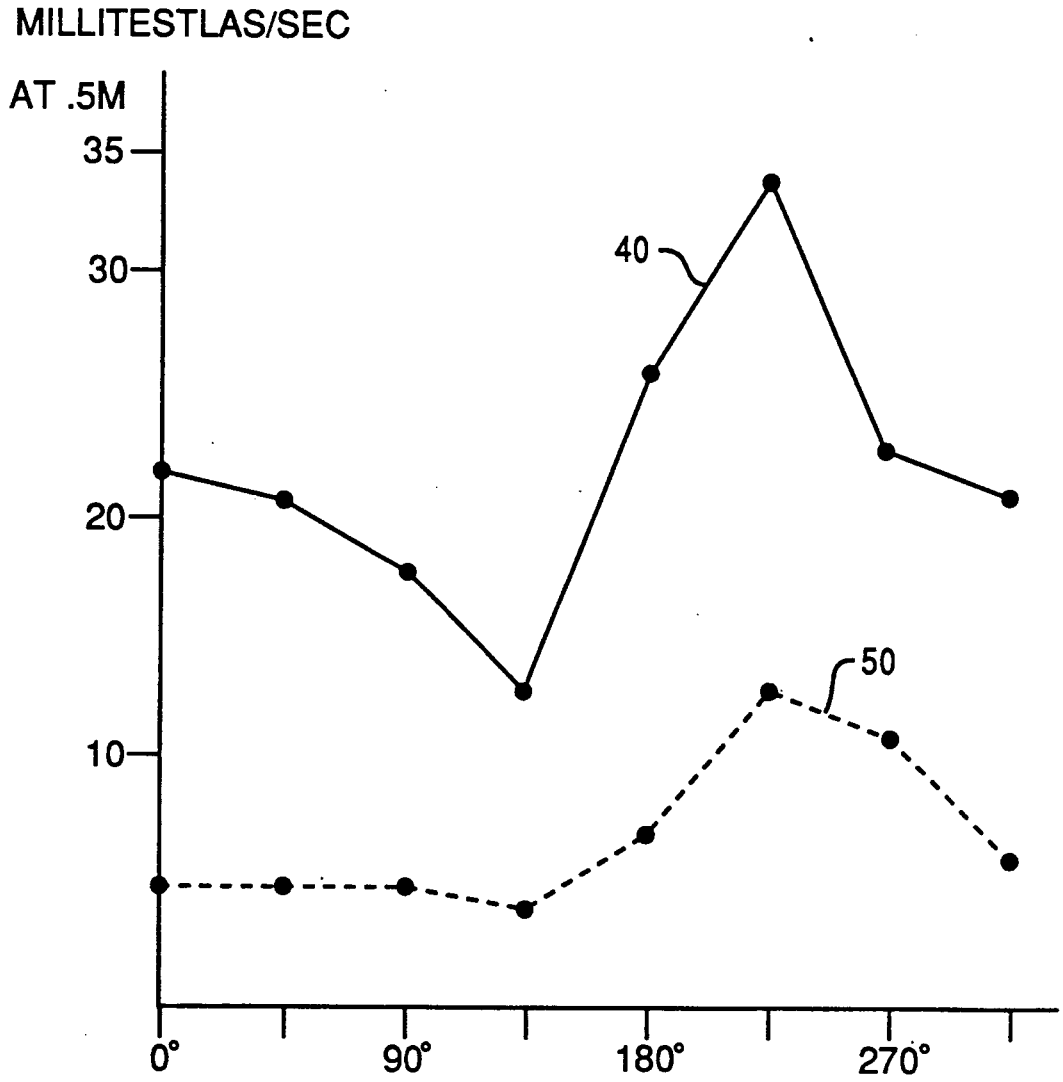
FIG. 3 is a graphical representation of the measured levels of magnetic induction of a known video display and of a video display that was modified according to the present invention.

The problem of this known horizontal sweep output circuit 10 of this known video display is that the superposition of the fluxes 34, 36 and 38 at the exterior of the display results in spacial magnetic induction levels that are too high to meet the Swedish magnetic emission specifications at 0.3 meters and 0.5 meters. Referring to FIG. 3, graph 40 is a plot of the magnetic induction at 0.5 meters as a function of the angular displacement around the video display under test in a horizontal plane with zero degrees being the middle of the CRT screen (not shown).

Figure 4:
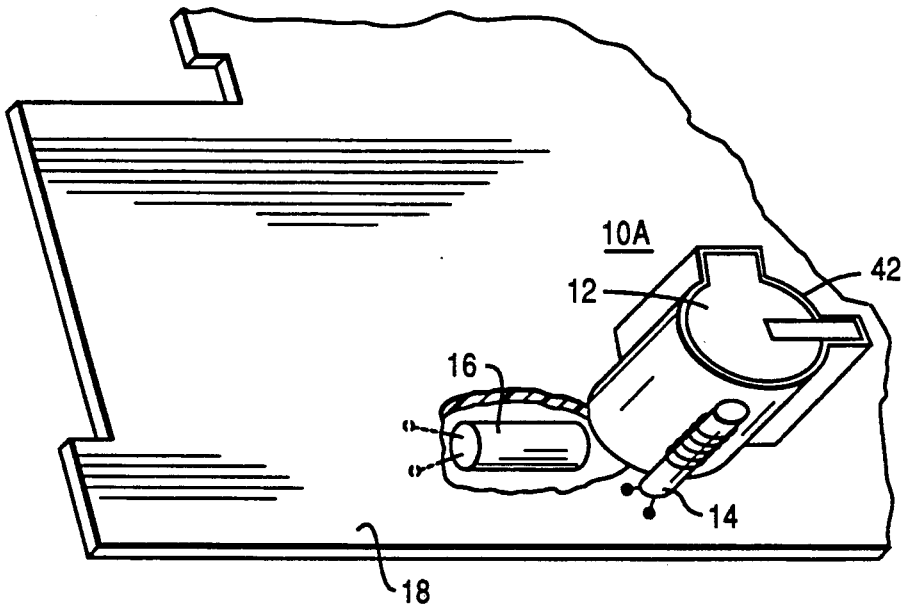
FIG. 4 is a simplified and partially broken away perspective view of a horizontal sweep output circuit according to the invention.
Figure 5:
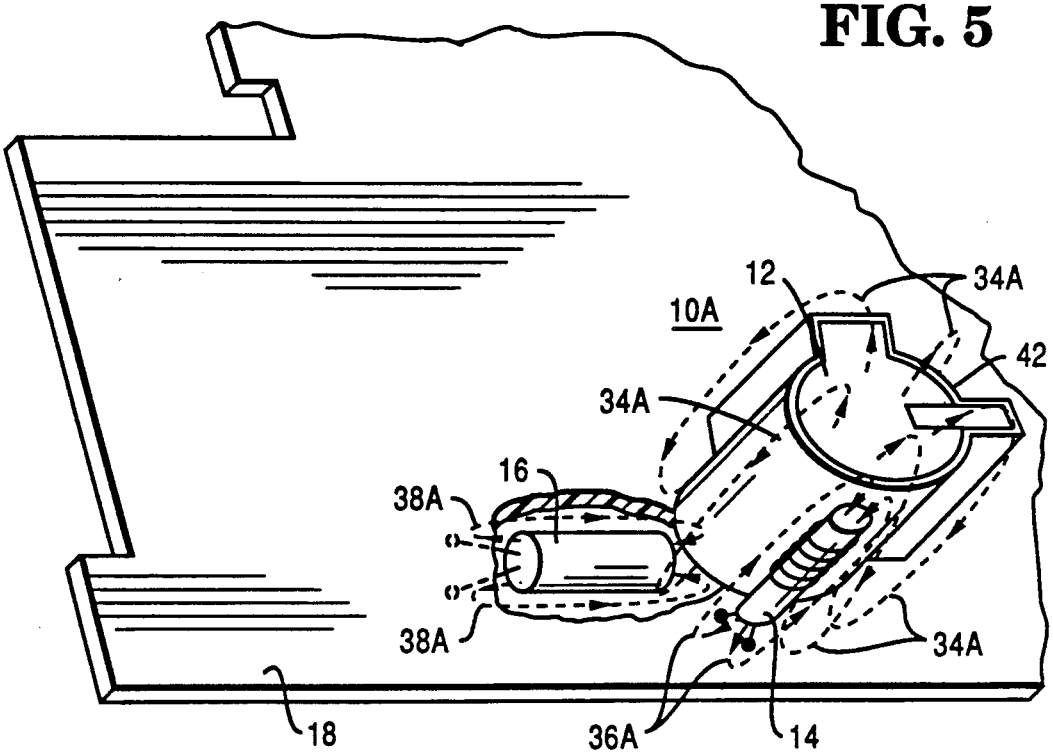
FIG. 5 is a pictorial representation of the magnetic flux of the horizontal sweep output circuit shown in FIG. 4.

Referring now to FIGS. 4, and 5 the horizontal sweep output circuit 10A according to the present invention is shown. The flyback transformer 12 is of the same type and is mounted in the same manner as the one shown in FIGS. 1 and 2. However, a conformal shield 42 has been placed around the flyback transformer 12 to reduce the amount of leakage flux 34A that is emitted from the flyback transformer 12.

The shield 42 is made of a thin sheet of a high conductivity material, such as copper or aluminum. The shield 42 may be preformed and slipped over the flyback transformer 12, or it may be wrapped around it. In the preferred embodiment of the present invention, the shield 42 is made from a sheet of copper foil that has a thin coat of insulation between the flyback transformer 12 and the copper. Further, the shield 42 has its lower edge covered by an insulating strip (not shown) to prevent an inadvertent connection with traces or electrical components on the printed circuit board 18.

In operation, a current is induced in a portion of the shield 42 by the time rate of change of the leakage flux through that portion. The energy of the induced current is partially dissipated by the resistance of the shield material. The remaining current energy generates a magnetic flux which is opposite to the leakage flux which induced the current in the first place. Thus, the shield 42 tends to cancel part of the leakage flux 34A which passes through it and thereby reduces the amount of leakage flux emitted from the flyback transformer 12.

Besides the addition of the shield 42, the locations and electrical connections of the horizontal width coil 14 and the horizontal linearity coil 16 are altered. The width coil 14 is moved from in front of the flyback transformer 12 to a position at the side of the flyback transformer 12 that is nearest to the edge of the printed circuit board 18, and generally corresponds to the former location of the linearity coil 16. In addition to the relocation, the electrical connections to the width coil 14 are changed such that the direction of the flux 36A with respect to its cylindrical axis is different than the direction of the flux 36 shown in FIG. 2A.

The linearity coil 16 is moved from lying horizontally at the side of the flyback transformer 12 to lying horizontally in front of the flyback transformer 12, but still having its cylindrical axis pointed in substantially the same direction. In the preferred embodiment, the new position of the linearity coil 16 is on the under side, i.e. the solder side, of the printed circuit board 18. This is the preferred embodiment because this allows the modification of the video display to be made without changing the layout of the printed circuit board 18. However, it is contemplated that there could be another embodiment of the present invention in which there is room to mount the linearity coil 16 on the component side of the printed circuit board 18.

In addition to the repositioning, the electrical connections to the linearity coil 16 are changed such that the direction of the flux 38A with respect to its cylindrical axis of symmetry is different than the direction of the flux 38 shown in FIG. 2A. Since the linearity coil 16, type JS86HL26 manufactured by Jet Signal Ind. Co. LTD, Taipei, Taiwan R.O.C., has a residual magnetic field within its ferrite core, this change in the direction of the current flow through the device will lower its inductance. By lowering the inductance of the linearity coil 16, the amount of flux 38A induced by the current is proportionally lowered, as well.

Width coil 14 and linearity coil 16, in the locations shown in FIG. 5, are oriented such that their fluxes 36A and 38A interact with the reduced flux 34A of the shielded flyback tranformer 12. The fluxes 34A, 36A, and 38A interact and partially cancel each other. The resultant or net flux of the horizontal sweep output circuit 10A is reduced even more than the reduced flux 34A emitted by the flyback transformer 12 if the shield 42 is installed.

Referring back to FIG. 3, the overall effect of the modification is shown by the graph 50. Graph 50 is a plot of the magnetic induction at 0.5 meters as a function of the angular displacement in a horizontal plane from the front of a video display after the display was modified in accordance with the present invention. The graph 50 shows the effectiveness of the cooperative action of the shield 42, and the changes in flux direction and position to coils 14 and 16.

Thus, it will now be understood that there has been disclosed a horizontal sweep output circuit which has substantially reduced magnetic emissions. While the invention has been particularly illustrated and described with reference to a preferred embodiment thereof, it will be understood by those skilled in the art that various changes in form, details, and applications may be made therein. It is accordingly intended that the appended claims shall cover all such changes in form, details and applications which do not depart from the true spirit and scope of the invention.

What is claimed as new and desired to be secured by Letters Patent of the United States is:

1. A horizontal sweep output circuit for a CRT, comprising:

a flyback transformer having a leakage flux, said flyback transformer having an approximately cylindrical shape;

a conductive sheet coaxially surrounding said flyback transformer to reduce the leakage flux therefrom; and a horizontal width coil having a flux with a direction that is opposed to said leakage flux, said horizontal width coil being proximately located to said flyback transformer such that part of said flux cancels part of said leakage flux;

whereby the net flux that is present in the near proximity of the horizontal sweep output circuit is less than said leakage flux of said flyback transformer.

2. The horizontal sweep circuit according to claim 1, further comprising:

a horizontal linearity coil having a second flux with a direction that is opposed to said leakage flux, said horizontal linearity coil being proximately located to said flyback transformer such that part of said second flux cancels part of said leakage flux;

whereby the net flux that is present in the near proximity of the horizontal sweep output circuit is less than the combination of said leakage flux of said flyback transformer and the flux of said horizontal width coil.

3. A horizontal sweep output circuit for a CRT, comprising:

a flyback transformer having a generally cylindrical shape and having a leakage flux;

a horizontal width coil having a generally cylindrical shape and having a first flux that has a direction that is opposed to said leakage flux;

said horizontal width coil is located such that its longitudinal axis is parallel to a longitudinal axis of said flyback transformer and is proximately located to said flyback transformer such that part of said first flux partially cancels said leakage flux;

a horizontal linearity coil having a generally cylindrical shape and having a second flux that has a direction that is opposed to said leakage flux;

said horizontal linearity coil is located such that its longitudinal axis is perpendicular to said longitudinal axis of said flyback transformer and is proximately located to said flyback transformer such that part of said second flux partially cancels said leakage flux;

whereby a net magnetic flux that is present in the near proximity of the horizontal sweep output circuit is a directional superposition of said leakage flux partially cancelled by said first and second fluxes.

4. The horizontal sweep circuit according to claim 3, further comprising a conductive sheet wrapped coaxially around said flyback transformer, said conductive sheet reducing said leakage flux of said flyback transformer, and thereby said net leakage flux is reduced.

5. The horizontal sweep circuit according to claim 4, wherein said conductive sheet is made primarily of copper.

6. A method for reducing a net leakage flux in a near proximity of a display device having a flyback transformer that has a leakage flux, a horizontal width coil that has a first flux, and a horizontal linearity coil having a second flux, comprising the steps of:

enveloping said flyback transformer in a conducting sheet that is coaxially located around a lateral surface of said flyback transformer; and arranging said flyback transformer, said horizontal width coil and said horizontal linearity coil such that a portion of said first flux, a portion of said second flux and a portion of said leakage flux nullify each other.

* * * * *